United States Patent [19]

Wild et al.

[11] Patent Number: 4,915,403

[45] Date of Patent: Apr. 10, 1990

[54] SKATEBOARD WITH MECHANICAL DRIVE

[76] Inventors: Charles Wild, 20, Chemin des Ormeaux, Epalinges; Antoine Bregger, Rue du Lac 26b, Renens, both of Switzerland

[21] Appl. No.: 292,445

[22] Filed: Dec. 30, 1988

[30] Foreign Application Priority Data

Jul. 15, 1988 [CH] Switzerland ..... 2726/88

[51] Int. Cl.[4] ..... B62M 1/08

[52] U.S. Cl. ..... 280/221; 280/11.115; 280/87.042; 280/257; 280/258

[58] Field of Search ..... 280/220, 221, 252, 253, 280/254, 255, 256, 257, 258, 87.042, 11.115

[56] References Cited

U.S. PATENT DOCUMENTS

| | | | |
|---|---|---|---|
| 1,477,544 | 12/1923 | D'Antonio | 280/221 |
| 1,529,952 | 3/1925 | Howe | 280/221 |
| 1,784,761 | 12/1930 | Smith | 280/11.115 |
| 4,084,831 | 4/1978 | Akonteh et al. | 280/11.2 |
| 4,582,342 | 4/1986 | Lew et al. | 280/221 |
| 4,667,368 | 5/1987 | Menqi | 17/23 |

FOREIGN PATENT DOCUMENTS

| | | |
|---|---|---|
| 156190 | 9/1903 | Fed. Rep. of Germany . |
| 3315856 | 10/1984 | Fed. Rep. of Germany . |
| 3427834 | 2/1986 | Fed. Rep. of Germany . |
| 93785 | 9/1988 | Fed. Rep. of Germany . |
| 444311 | 10/1912 | France . |
| 2573661 | 5/1986 | France . |
| 99784 | 4/1922 | Switzerland . |

*Primary Examiner*—Charles A. Marmor
*Assistant Examiner*—Donn McGiehan
*Attorney, Agent, or Firm*—Ralph W. Selitto, Jr.

[57] ABSTRACT

A skateboard has a frame (1) on which a petal (*7b*) is pivotably mounted. When the pedal (*7b*) is pressed down its movement is converted via a push rod (16), a crank (26) and a toothed segment (29) into a rotational movement which is transmitted to a gear train (2). The output pinion of the gear train (2) is fixedly connected to the shaft of the two drive rollers (4). The push rod (16), in each case via a ball-and-socket joint (19*a*, 19*b*), is connected to both the pedal (*7b*) and the toothed segment (29) so that the transmission of the drive force is ensured even during tilting of the pedal (*7b*) caused when riding around curves. This mechanically driveable skateboard has the same height as a conventional skateboard and enables relatively high speeds to be reached while retaining the diverse possibilities such as ease in negotiating curves and maneuverability.

4 Claims, 7 Drawing Sheets

SKATEBOARD WITH MECHANICAL DRIVE

FIELD OF THE INVENTION

The invention relates to a skateboard, and more particularly, to a self-propelled skateboard having a mechanical drive to the preamble of independent patent claim 1.

BACKGROUND OF THE INVENTION

A conventional skateboard is set in motion by its user standing on the skateboard with one foot and pushing off from the ground with the other foot. In the process, it is of disadvantage that additional acceleration can only be achieved by continually pushing off from the ground, and thus the user can never maintain his ideal posture on the board for prolonged periods. Also, only limited speeds can be reached with the conventional skateboards operated in the manner described above, which represents a further disadvantage for the modern skateboard riding technique.

German Offenlegungsschrift No. 3,427,834 shows a skateboard on which two drive wheels arranged on the same shaft can be driven by a rocking motion of a pivotably mounted board. The rocking motion is transmitted to the two drive wheels by means of a chain which is guided over gears which in turn mesh with a pinion gear attached to the drive shaft.

In view of this type of drive, the board on which the user stands must be located exceptionally high, resulting in an unsafe standing position, which, moreover, makes riding around curves and also figure riding considerably more difficult. In the freewheeling position, in which the skateboard is supposed to roll along freely after the preceding drive, the user stands in either an uncomfortable sloping position or in the horizontal position at an increased height, which is unreasonable for normal skateboarding operation. Furthermore, with the drive wheels protruding laterally beyond the board, there is the risk of getting caught or tripping. For all these reasons the known skateboard is hardly likely to be suitable for practical use.

The drive mechanisms known from roller skis or roller skates cannot be adapted for use with skateboards since the rider would have to stand successfully with both feet on the same end. A rider would have to maintain his balance even when riding around curves. This does not permit these abovementioned mechanisms to be transferred to the skateboard construction.

A particular difficulty of designing a skateboard drive mechanism results from the board, elastically mounted on the wheel axles, being subjected to considerable tilting on curves. The drive connection mechanism disengages on curves.

It is the object of the present invention to propose a mechanically operable skateboard which corresponds to the normal overall height of conventional skateboards and, thus retains the diverse possibilities which the conventional skateboard offers the experienced user.

It is a further object of the present invention to provide a self-propelled skateboard having a drive mechanism elastically mounted to a frame which is allowed to tilt with respect to the frame.

SUMMARY OF THE INVENTION

The present invention provides a skateboard having a frame atop which a pedal is pivotably mounted and beneath which a drive mechanism is elastically mounted. The pedal pushes on a push rod which pushes on a crank. The crank converts linear motion provided by the pedal into rotary motion which is transferred to a toothed segment. The toothed segment engages a gear train to rotate a drive shaft. The push rod is connected between the pedal and crank by first and second ball-and-socket joints, respectively, which allow the push rod to act on the crank in an unimpeded manner and adapt to the sloping positions of the pedal caused by riding the skateboard around curves.

DETAILED DESCRIPTION OF THE EXEMPLARY EMBODIMENT

Figure 1:
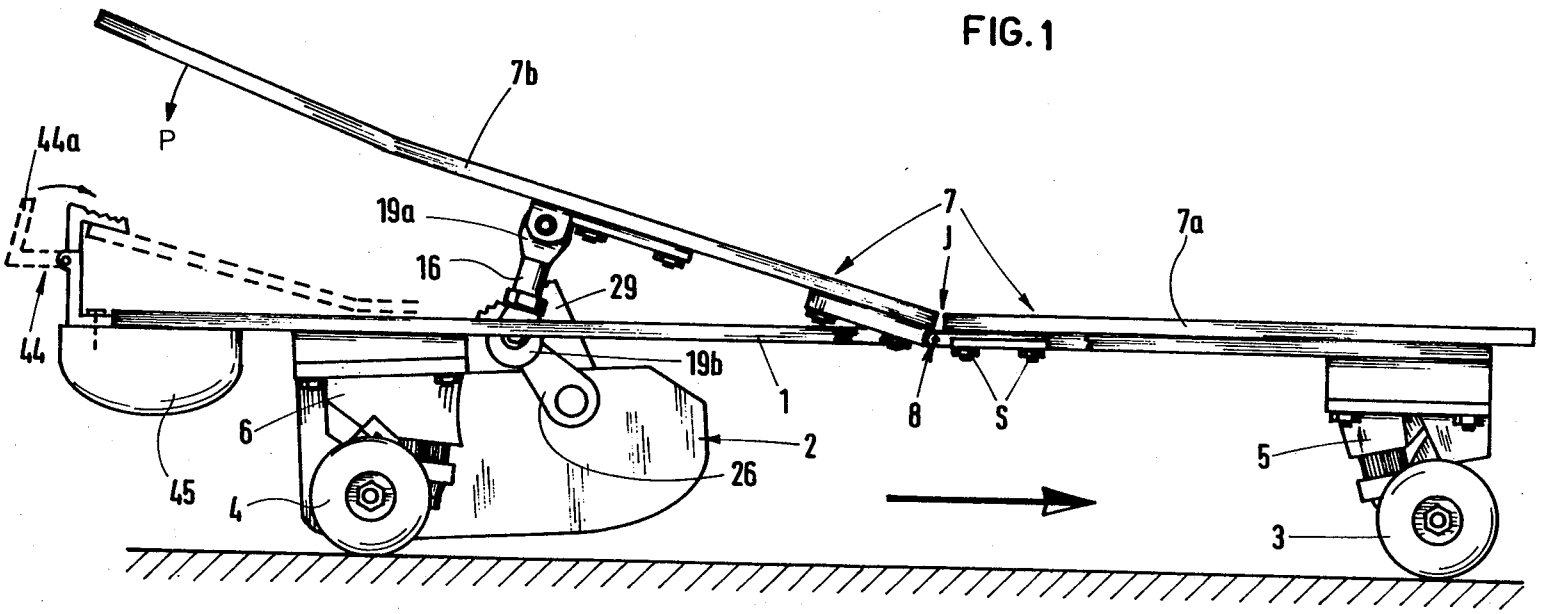
FIG. 1 is a side view of this preferred exemplary embodiment.

The skateboard, shown in its entirety in FIG. 1, has a frame 1, a gear train 2 two free rollers 3, located at the front of the frame 1 (only one roller 3 being visible in FIG. 1) two drive rollers 4 located at the rear of the frame 1 (only one roller 4 being visible in FIG. 1) and the associated front and rear suspensions 5 and 6. The frame 1 and rollers 3 and 4 are made of materials commonly employed for conventional skateboards. A board 7 arranged on the frame 1 is subdivided into a fixed section *7a* and a pedal section *7b* at the location J. The fixed section *7a* is rigidly fixed to the frame 1 by means of screws S. The skateboard is propelled in the direction shown by the arrow. Accordingly, the fixed section *7a* is located at the front of the frame 1. The pedal *7b* is movably articulated on the pedal *7a* by means of a hinge 8. The section *7b* could also be movably mounted directly on the frame 1. On account of this arrangement, the pedal *7b* can be pressed downwards about the axis of the hinge 8 in the direction of the arrow P (FIG. 1) until it has reached its lowermost position shown by broken lines.

Since the hinge 8 extends over the entire width of the board, the pedal *7b* is reliably guided against lateral displacement.

Figure 3:
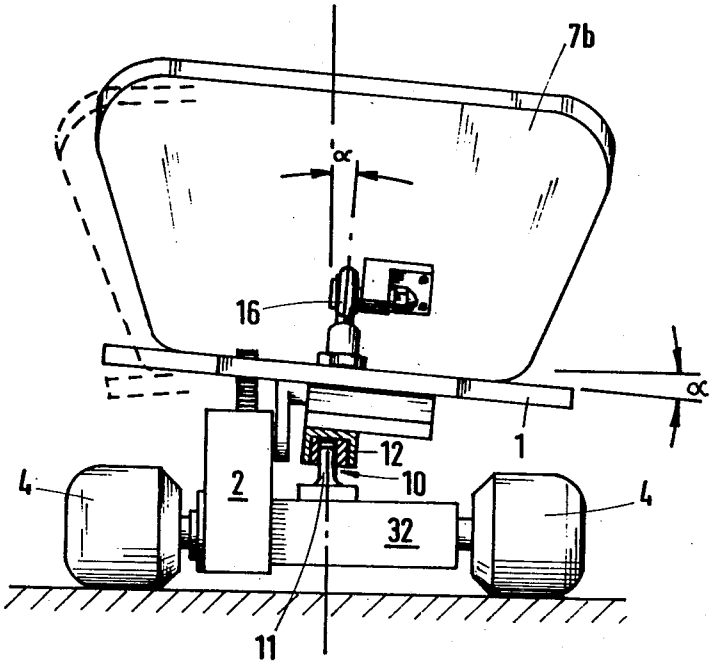
FIGS. 2 and 3 are front views.
Figure 2:
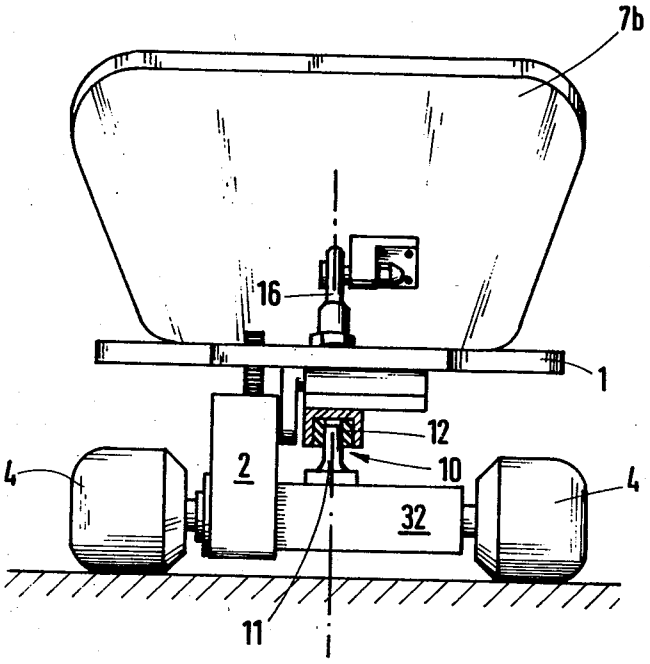

As follows from FIGS. 2 and 3, an elastically mounted member 10 ensures that the frame 1 and the pedal *7b* always maintain their relative position, when riding around curves. Thus, when the frame 1 tilts by an angle, the pedal *7a* tilts with it, the tilt being absorbed by the elastically mounted member 10 indicated schematically in FIG. 4.

In the preferred embodiment, this elastic member is a pin 11 whose upper part protrudes into a rubber sleeve 12.

A clamp 44 has an elastically resilient clamping finger 44*a* at the one end and is pivotably attached at the opposite end to the rear of the frame 1. The function of the clamp 44 and finger 44*a* will be discussed hereinafter. A conventional friction brake 45 is attached to the rear underside of the frame 1.

Figure 4:
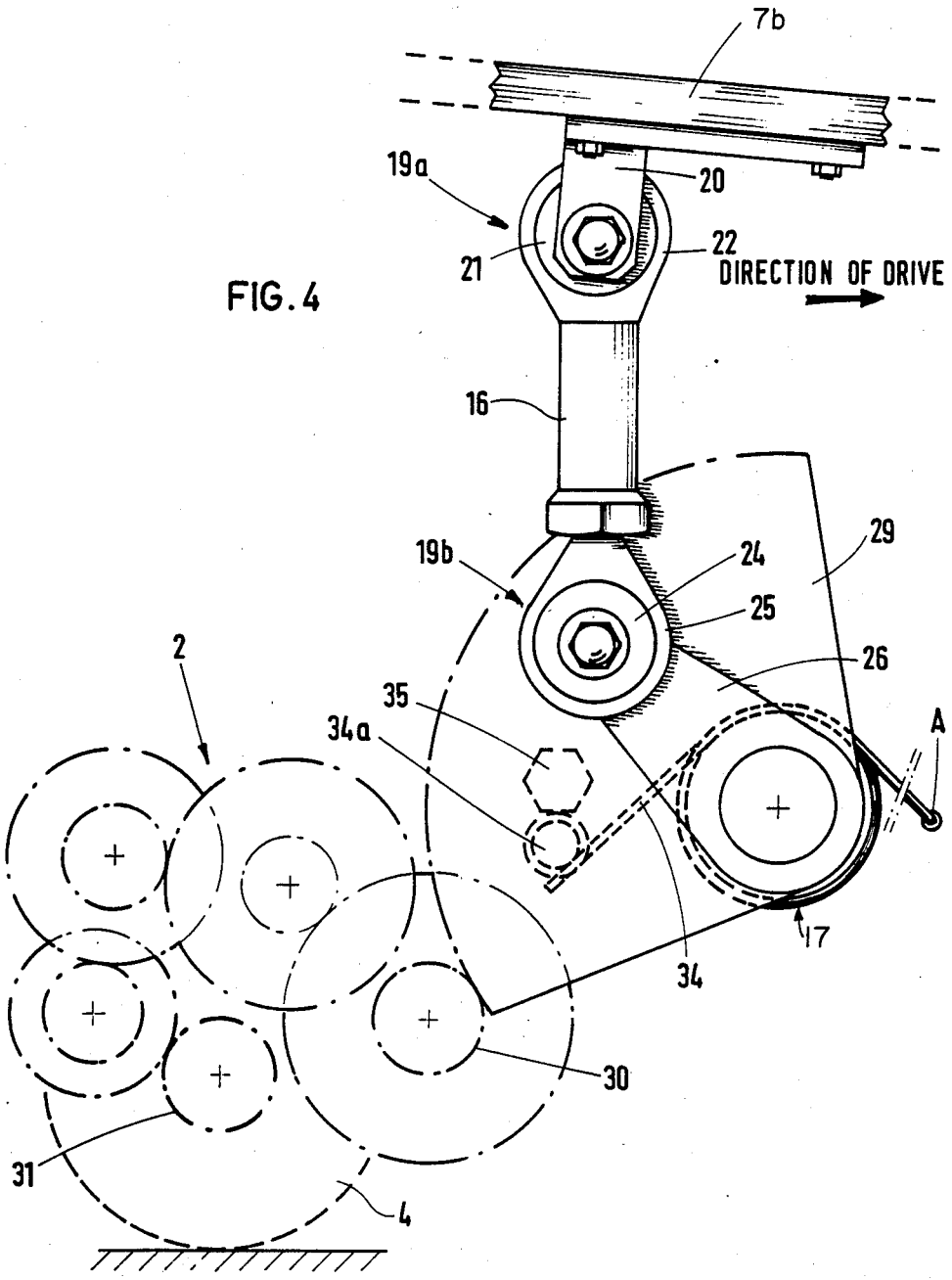
FIG. 4 is a schematic representation, of the torque transmission members and the gear train.
Figure 5:
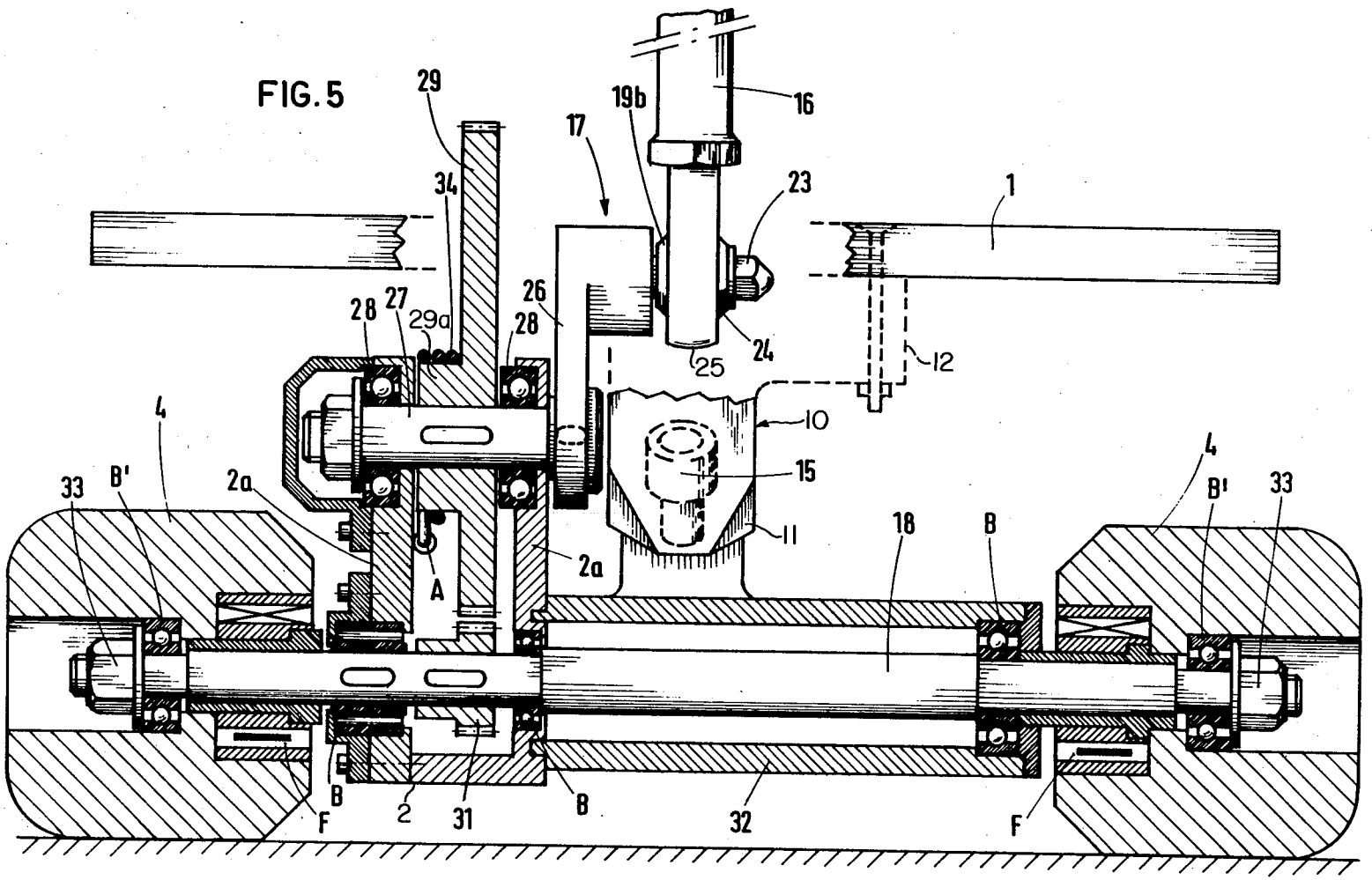
FIG. 5 shows the torque transmission members and the gear train, the latter in section.

FIGS. 4 and 5 illustrate the transmission of the force, exerted on the pedal 7*b* by the user, to the drive rollers 4. The force is converted into a torque by means of a push rod 16 and a crank 17 and then transmitted via the gear train 2 to the shaft 18 rigidly connecting the two drive rollers 4. The push rod 16 is fixed to the pedal 7*b* via a first ball-and-socket joint 19*a* which has a steel ball 21, fixed to the pedal 7*b* by means of a bracket 20, and a sleeve 22 which encloses this steel ball 21 in a spherical seat. Similarly, a crank pin 23 (FIG. 5), is mounted in a second ball-and-socket joint 19*b* and accordingly carries a laterally truncated ball 24 which is enclosed by a corresponding spherical bearing 25 of the push rod 16. The first and second ball-and-socket joints 19*a* and 19*b* allow the push rod 16 to adapt to the positional changes of the pedal 7*b* and, in every position, to transmit to the crank 17 the force exerted on the pedal 7*b*.

The second ball-and-socket joint 19*b* of the push rod 16 therefore acts on the end of the crank pin 23, which extends through an arm 26 of the crank 17. The crank pin 23 is fixed in the peripheral marginal area of the toothed segment 29 and projects from the gear train 2 to such an extent that the second ball-and-socket joint 19*b* can adapt in an unimpeded manner to the sloping positions of the pedal 7*b* which result when riding around curves.

The crank arm 26 (FIGS. 4 and 5) is connected non-rotationally to the input shaft 27 of the gear train 2, which is arranged for rotation in the side walls 2*a* of the gear train 2 by ball bearings 28. Keyed to the input shaft 27 of the gear train 2 is the toothed segment 29 whose tooth system meshes with the first gear pinion 30. Via intermediate gears indicated by chain-dotted lines in FIG. 4, the torque is now transmitted to the last gear 31, which is fixed non-rotationally on the drive shaft 18. The drive shaft 18 is mounted for rotation to the sidewalls 2*a* by roller and/or ball bearings B which in turn are arranged in a shaft housing 32. As shown in FIG. 5, the shaft housing 32 is attached to the elastically mounted member 10 and to one sidewall 2*a*. The drive shaft 18 extends through inner races of ball bearings B' located at opposite ends thereof. The two drive rollers 4 are affixed to outer races of ball bearings B' for free rotation about the drive shaft 18, and are held on the shaft 18 by nuts 33. The drive shaft 18 transmits a force to the wheels 4 through freewheeling clutches F, as will be described hereinafter.

The toothed segment 29 (FIGS. 4 and 5) is under the constant action of a torsion spring 34 located on hub 29*a* thereof. One end of the torsion spring 34 is anchored to the toothed segment at location 34*a*, and the other end is anchored at the location A on the sidewall 2*a*. The torsion spring 34 urges the toothed segment 29 into its upper position in which the pedal 7*b* is located in the position according to FIG. 1. This uppermost position of the toothed segment 29 is limited by a stop pin 35 (FIG. 4) fixed to the sidewall 2*a*.

According to FIG. 5, the drive shaft 18 attaches to the free wheeling clutches F which are located in both drive wheels 4. The free wheeling clutches F allow toothed segment 29 to drive the drive wheels 4 during the downwards movement of the pedal 7*b*. Additionally, the free wheeling clutches F prevent the entire gear train 2 from running along during the return movement of the toothed segment 29 effected by the spring 34. These freewheeling clutches F, which correspond to a known construction and are also designated as over-running clutches, can be designed, for example, as grip-roller freewheels that frictionally transmit the torque exerted by the toothed segment 29 to the rollers 4, but run freely during the return movement of the toothed segment 29.

Figure 6:
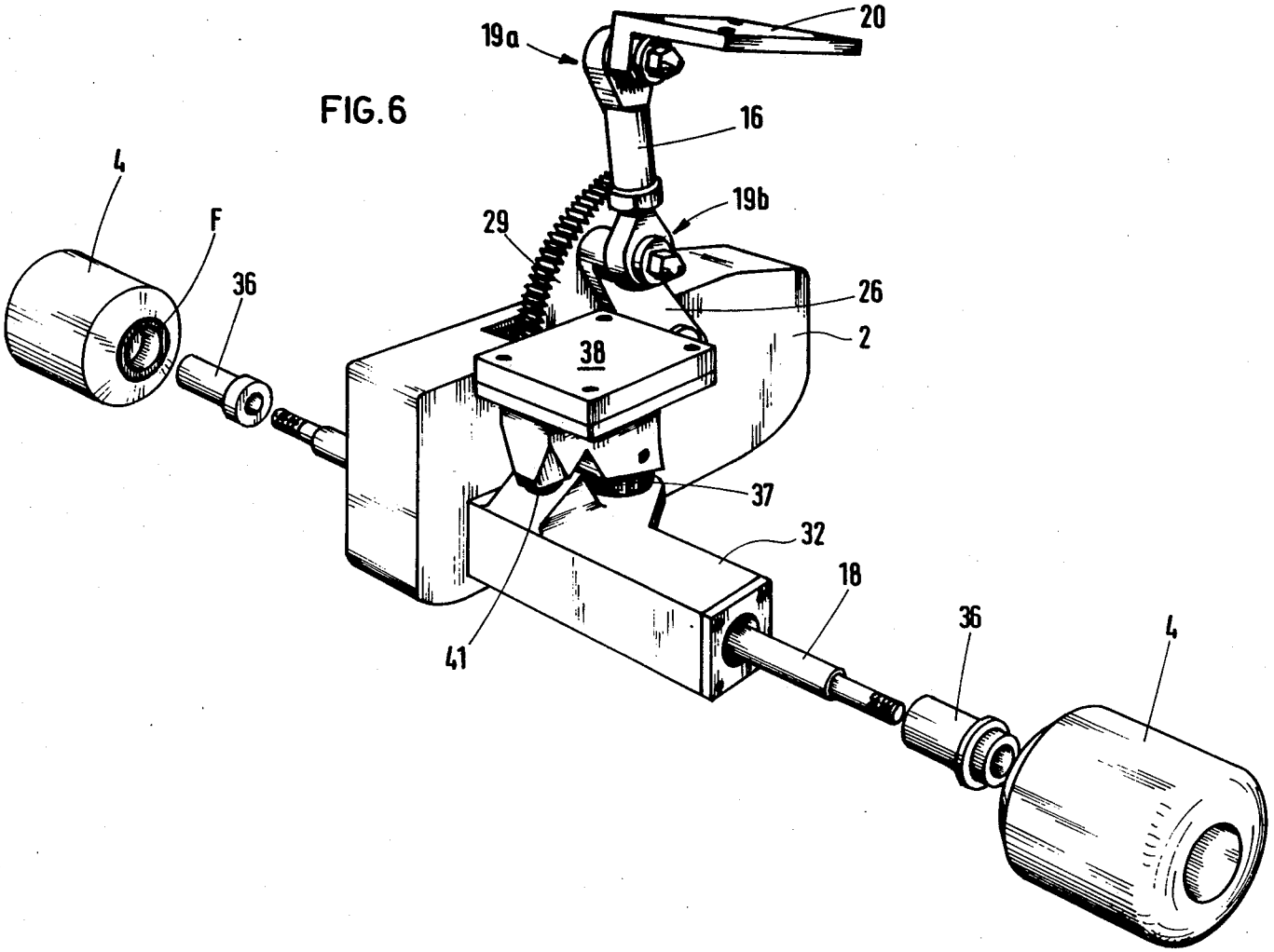
FIG. 6 is a perspective representation of the drive rollers with the associated transmission mechanism.

FIG. 6 shows a freewheeling clutch F pressed into a drive roller 4, the shaft 18 being screwed into corresponding adapting sleeves 36 mounted in the rollers 4.

Figure 8:
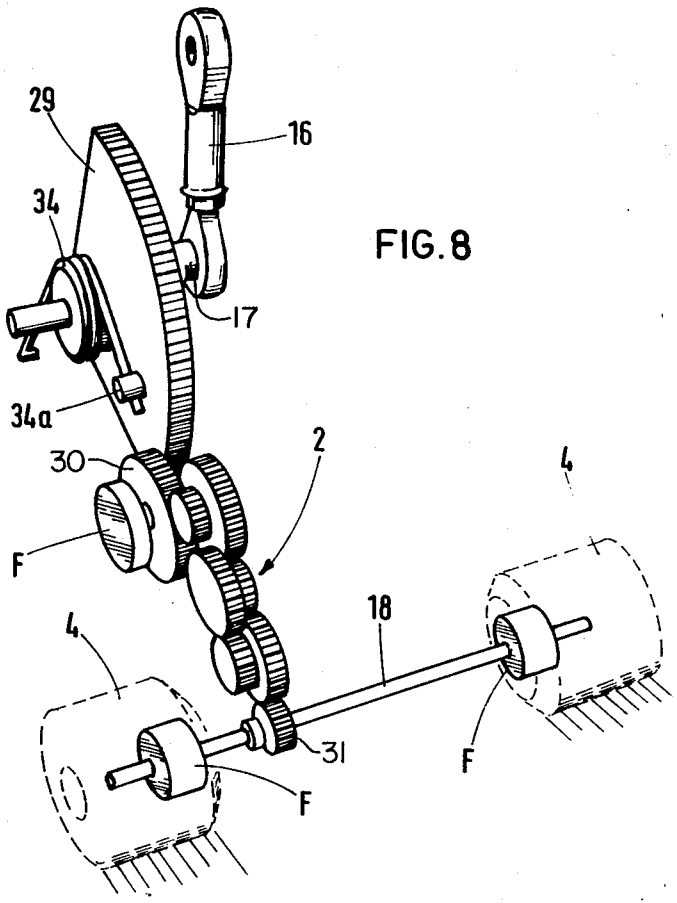
FIGS. 7 and 8, are side and in perspective views, respectively of the elastic pretensioning of the toothed segment and the arrangement of freewheeling clutches.
Figure 7:
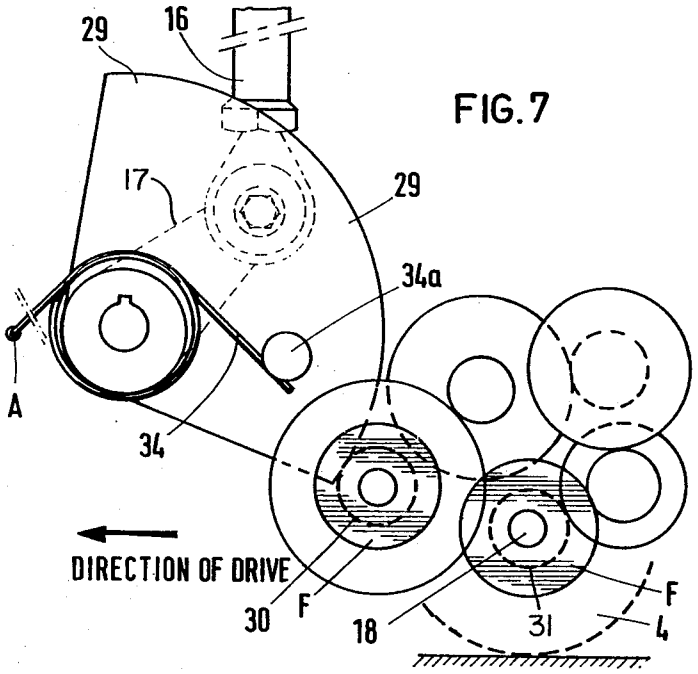

Referring now to FIGS. 7 and 8, there is shown a more detailed view of the intermediate gears adapted to transfer torque from the first gear pinion 30 to the last gear 31. The intermediate gears function to convert the torque generated by the push rod 16 and crank 17 into a torque suitable for propelling the skateboard. A detailed description of the intermediate gears is deemed unnecessary since the number of gears required, and the dimensions and arrangement thereof can be easily determined by a person skilled in the art.

Figure 10:
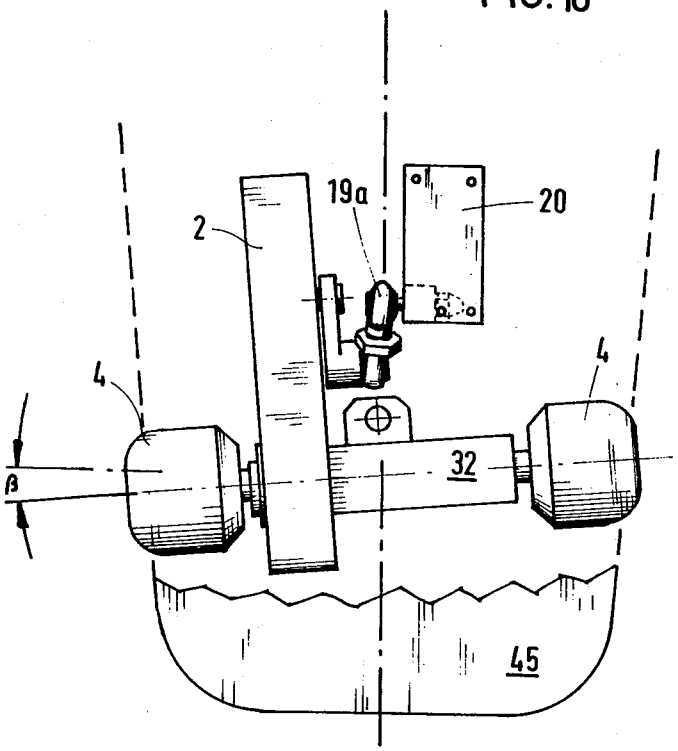
FIG. 10 shows a plan view of the force-transmission members when riding around a curve.
Figure 9:
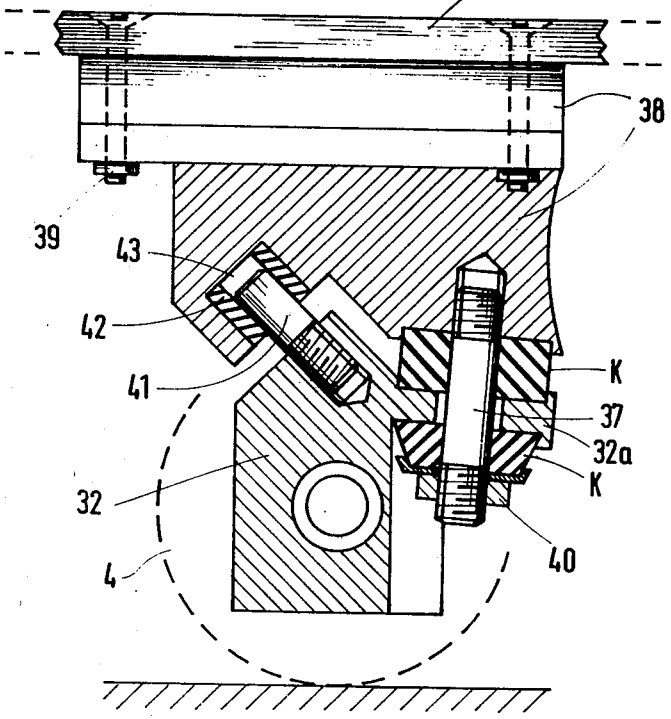
FIG. 9 shows a detailed view of a bearing arrangement of a shaft housing and frame.

Referring now to FIGS. 9 and 10, the shaft housing 32 carrying the drive shaft 18 is conveniently fixed to the frame 1. The shaft housing 32, by means of an elastically mounted pin 37 threadedly engaged with a bracket 38 which is fixed to the frame 1 by means of screws 39. A nut 40 screwed onto the pin 37 presses two elastic pads K against a lateral projection 32*a* extending from the shaft housing 32 and thus holds shaft housing 32 to frame 1. Undesired tilting of the roller attachment (designated by angle in FIG. 10) is prevented by a further pin 41 which projects from the shaft housing 32 and protrudes into the elastic sleeve 42 of a blind bore 43 of the bracket 38. This results in considerable stabilization of the rollers 4 in the face of the stresses occurring in the longitudinal direction of the skateboard.

To use the skateboard without a drive, the pedal 7*b*, according to FIG. 1, can be fixed to the frame 1 the a clamp 44. The resilient clamping finger 44*a* secures the pedal 7*b* in its horizontal position.

The clamp 44 is also used for operating the skateboard with the gear train 2. When starting, the drive board should be located in its horizontal position as shown by broken lines in FIG. 1. As soon as the skateboard has reached a certain speed, the user stands with both feet on the drive board 7 and pushes the clamp 44 forwards with the tip of the toe, whereby the gear train 2 is ready for operation.

It will be understood that the embodiment described herein is merely exemplary and that a person skilled in the art may make many variations and modifications without departing from the spirit and scope of the invention. All such variations and modifications are intended to be included within the scope of the invention as defined in the appended claims.

We claim:

1. A skateboard comprising:

an elongated frame disposed horizontally having a front end, a rear end and a midpoint;

two free rollers mounted to the front end of said frame for free rotation;

a plate adapted to form a standing surface and divided into a fixed board and a pedal having a first end and a second end, said fixed board being rigidly attached to said frame between the midpoint and the front end, said pedal being located between the midpoint and the rear end of said frame and having its first end pivotably mounted to the midpoint of said frame for movement between a horizontal position and an inclined position located generally above the horizontal position;

an elastic return member adapted to urge said pedal from the horizontal position to the inclined position, whereby, after said pedal has been depressed from the inclined position to the horizontal position and then released, it is automatically urged back to the inclined position by said elastic return member;

a transmission located underneath said frame between the midpoint and the rear end thereof and including a drive shaft, a drive shaft housing surrounding said drive shaft and allowing said drive shaft to rotate therein in a first direction and a second direction which is opposite to the first direction, two drive rollers located at opposite ends of said drive shaft and attached thereto for conjoint rotation therewith when said drive shaft rotates in the first direction and for free rotation thereabout when said drive shaft rotates in the second direction, and a gear box attached to said drive shaft housing and including a rotatable input gear and a rotatable output gear which rotates in response to the rotation of said input gear, said output gear rotating said drive shaft in the first direction and the second direction;

elastic fixing members which suspend said drive shaft housing from said frame such that said drive shaft extends transversely across said frame, said elastic fixing members allowing said frame and said transmission to tilt with respect to said pedal when said skateboard is riding around a curve; and linkage elements including a crank arm having a first end and a second end, a toothed segment having one side fixedly attached to the first end of said crank arm and the other side rotatably attached to said transmission, said toothed segment being operative to rotate said input gear of said gear box, a pin attached to the second end of said crank arm and extending away from said toothed segment, said pin being operative to rotate said crank arm about said first end thereof, and a push rod having a first ball-and-socket joint located at one end and connected to said pedal and a second ball-and-socket joint located at an opposite end and connected to said pin, said first and second ball-and-socket joints allowing said push rod to act on said pin in an unimpeded manner and adapt to the sloping positions of said pedal caused by riding the skateboard around curves, thereby allowing said transmission to tilt with respect to said frame, whereby the depression of said pedal causes said push rod to push on said pin and rotate said toothed segment such that said drive shaft and said drive wheels rotate conjointly in the first direction to propel said skateboard and whereby said drive shaft rotates in the second direction upon the release of said pedal such that the motion of the skateboard is unaffected.

2. The skateboard according to claim 1, wherein the second end of said pedal is fixed to said frame by a locking member.

3. The skateboard according to claim 2, wherein said locking member is an elastic clamp.

4. The skateboard according to claim 2, wherein said drive rollers are provided with free-wheeling clutches to allow said drive wheels to rotate conjointly with said drive shaft when said drive shaft rotates in the first direction, and to rotate freely about said drive shaft when said drive shaft rotates in the second direction.

* * * * *